United States Patent [19]

Vogel et al.

[11] 3,996,843

[45] Dec. 14, 1976

[54] METHOD OF EXPANDING A CARTON

[75] Inventors: Walter H. Vogel, Hoffman Estates; Thomas E. Close, Joliet, both of Ill.

[73] Assignee: Redington, Incorporated, Bellwood, Ill.

[22] Filed: Dec. 22, 1975

[21] Appl. No.: 643,218

Related U.S. Application Data

[62] Division of Ser. No. 512,763, Oct. 4, 1974, Pat. No. 3,956,976.

[52] U.S. Cl. ..... 93/53 M; 93/49 M

[51] Int. Cl.[2] ..... B31B 1/76

[58] Field of Search ..... 53/381 R; 93/53 M, 53 R, 93/53 SD, 53 BF, 53 LF, 49 M, 49 R

[56] References Cited

UNITED STATES PATENTS

| | | | |
|---|---|---|---|
| 2,900,880 | 8/1959 | Engleson et al. | 93/53 SD |
| 3,040,635 | 6/1962 | Engleson et al. | 93/53 R |
| 3,451,318 | 6/1969 | Arnaudon et al. | 93/53 M |

*Primary Examiner*—James F. Coan

*Attorney, Agent, or Firm*—Prangley, Dithmar, Vogel, Sandler & Stotland

[57] ABSTRACT

The method of expanding and transferring a carton from a stack of collapsed cartons in a magazine to a bucket on a conveyor wherein the cartons comprise at one end thereof two side flaps and a front flap which includes a tuck flap. The method of expanding the carton comprises partially expanding the carton, closing the front flap while the carton is partially expanded thereby spreading the second flap outwardly, holding the second flap open while spreading the first and front flaps outwardly by applying pressure from the inside surfaces thereof and fully expanding the carton while holding the first, second and front flaps in their spread position.

2 Claims, 7 Drawing Figures

C1
C2
98
90
84
52
36
18
50
60
34
92
59
44
62
68
72
16
66
42
58
94
14

68
58
62
64
72
70
66
44

METHOD OF EXPANDING A CARTON

This applicaton is a division of our co-pending U.S. application Ser. No. 512,763 filed Oct. 4, 1974 now U.S. Pat. No. 3,956,976.

BACKGROUND OF THE INVENTION

This invention is directed to a method of expanding a collapsed carton for packaging machinery. Prior art machines utilize a single pivoted suction device which removes the lowermost carton of a stack of collapsed cartons and deposits the carton in the bucket of a conveyor by either stradling the conveyor or passing between a split conveyor. Means are employed between the stack and the conveyor to expand the carton. The speed of this type of machine is limited in that the suction device cannot be brought back to the stack of collapsed cartons until the carton moves out of the way. Attempts to solve this problem include the use of two or more elements to transfer the carton in different stages which greatly complicates the machine. One of the simplest of these mechanisms comprises a pair of spaced transfer wheels provided with cutouts. A pivoted suction device is used to extract the carton from the magazine and to deposit it within the cutouts of the transfer wheels. The carton is then transferred from the wheels to a conveyor bucket. Some variations in carton size can be accommodated by offsetting the cutouts of one wheel to the other, however, only a limited size range can be accommodated.

In addition to expanding the carton, the flaps at one end of the carton must be spread outwardly so that they do not interfere with the insertion of a product into the expanded carton. The flaps of the carton typically comprise two equal side flaps and a front flap which includes a tuck flap at the end thereof and which extends beyond the side flaps. Since the front flap extends beyond the side flaps it is relatively easy to employ a stationary cam surface for engaging the front flap and spreading it back as the expanded carton is advanced past the cam surface. However, the side flaps present a problem since they are of equal length. This problem is solved by employing a rotating or reciprocating member which is timed to wipe against one of the side flaps and spread it back as the expanded carton is being transferred from a stack to a conveyor. With one side flap spread back, it is then relatively easy to spread the other side flaps back by conveying the opened carton by a stationary cam surface as long as the carton is orientated so that the remaining side flap to be spread is the trailing flap of the moving carton.

SUMMARY OF THE INVENTION

It is a primary object of the invention to eliminate the need of a positively operated side flap spreader by providing a novel method of expanding a carton and spreading the flaps of at least one end of a carton to enable a product to be easily inserted in the expanded carton.

The object of the invention is accomplished by expanding a collapsed carton which has at one end thereof a pair of side flaps and a front flap which includes a tuck flap. When the carton is in the unexpanded state, these flaps lie in the same planes as the sides from which they extend. The carton is partially expanded and the front flap is pushed in so that it pushes against the inside of one of these side flaps and spreads it outwardly. This side flap is then held and the front flap released after which the remaining side flap and front flap are engaged on their inside surfaces and spread outwardly. Finally, all three flaps are held in spread position while the carton is fully expanded. The spreading of the flaps in this novel manner is accomplished by a plurality of cam surfaces located at strategic points along the path of travel of the carton from a stack of cartons in a magazine to a conveyor.

DETAILED DESCRIPTION OF THE INVENTION

Figure 1:
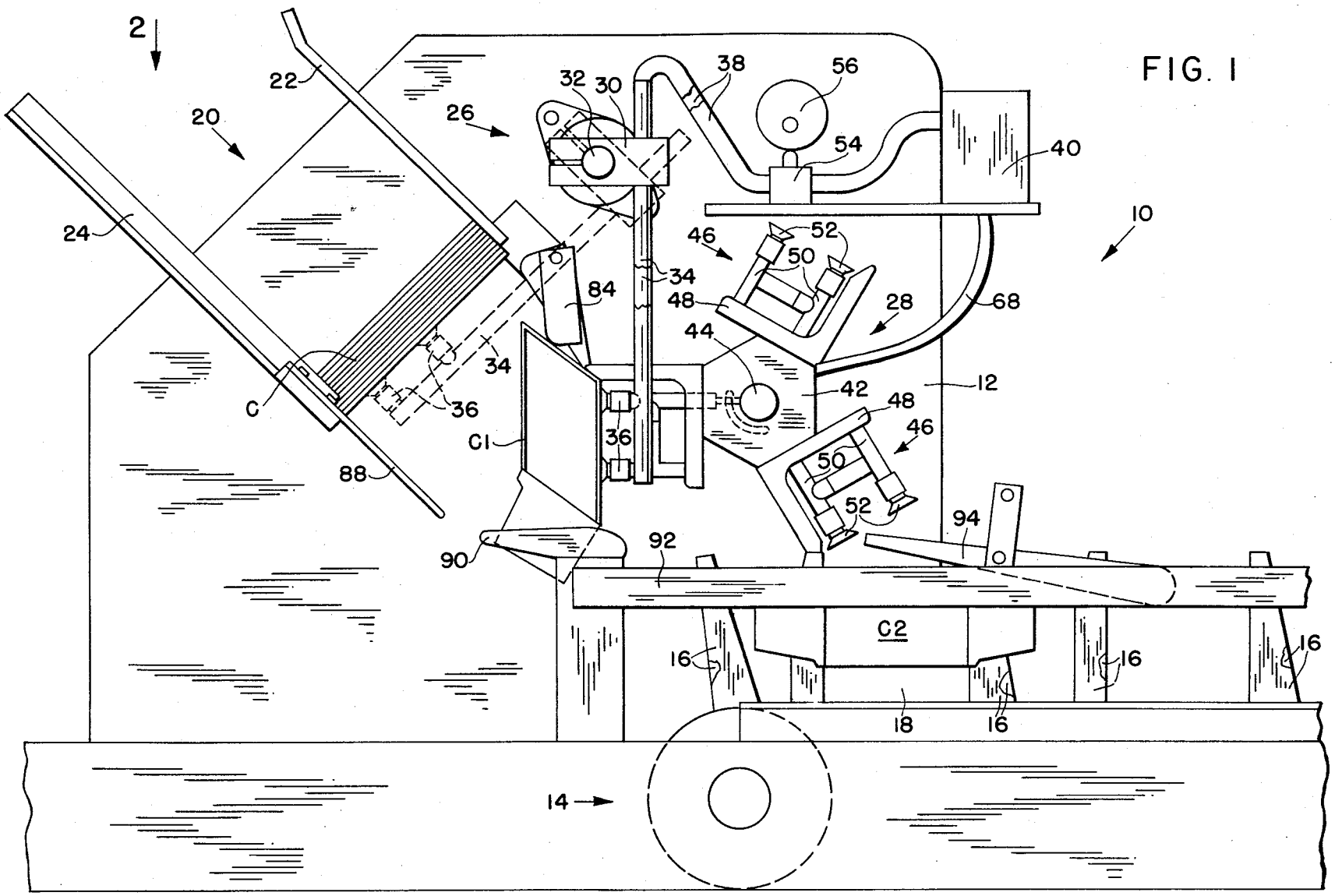
FIG. 1 is a view in side elevation showing apparatus for carrying out the present invention.
Figure 2:
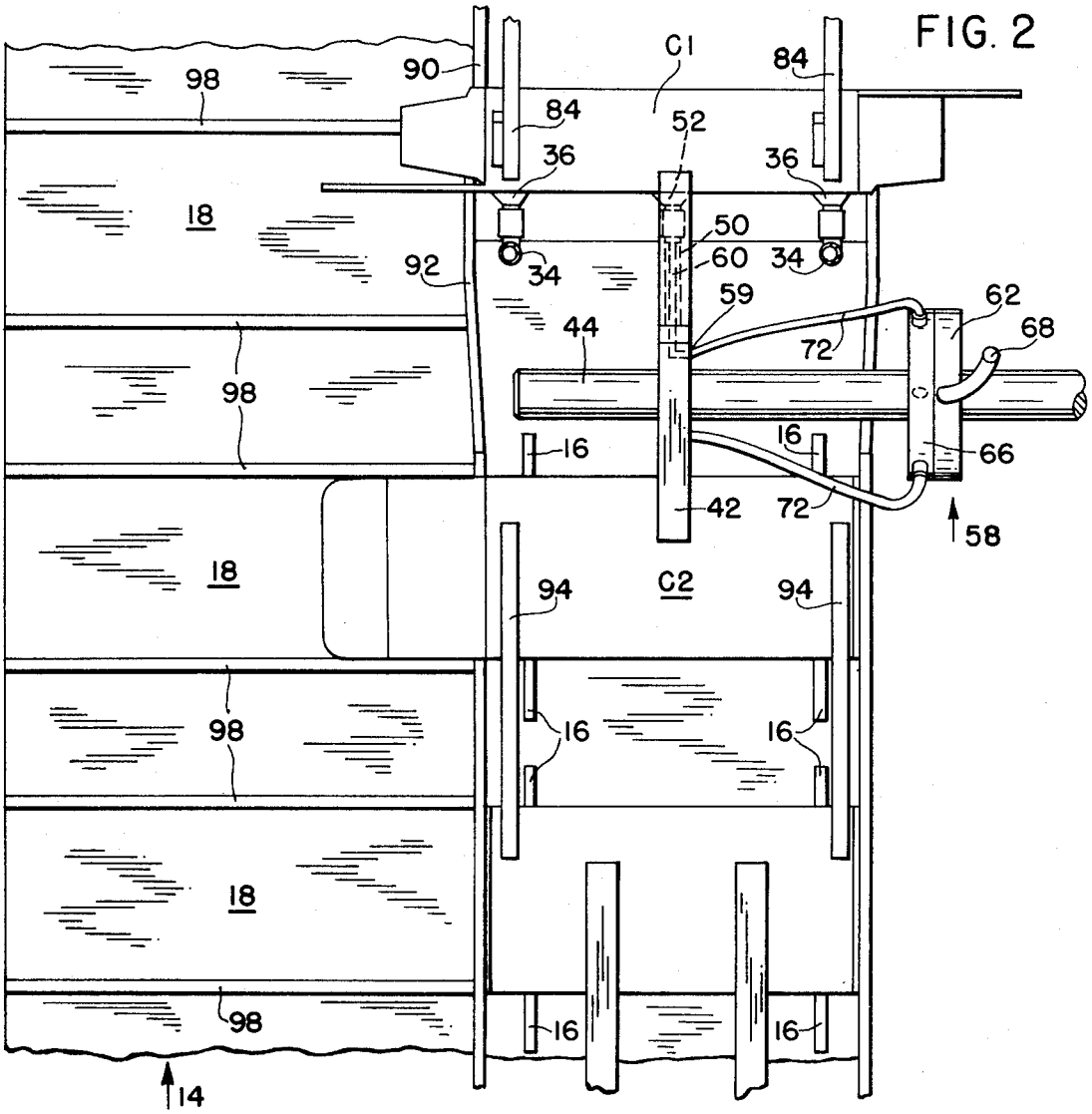
FIG. 2 is a plan view thereof.

Referring particularly to FIGS. 1 and 2 the packaging machine for carrying out the present invention is generally indicated by the reference numeral 10 and includes framework indicated at 12. A conveyor generally indicated by the reference numeral 14 extends longitudinally of the machine and is provided with a plurality of spaced pairs of lugs 16 which form pockets or buckets 18 therebetween. Buckets 18 are adapted to receive expanded cartons and carry them along the machine to be subsequently filled with product by mechanism not shown but well known in the art.

The magazine for supporting the collapsed cartons is identified by the reference numeral 20 and is mounted on the framework 12. Magazine 20 comprises an upper wall 22 and lower 24 wall which are adjustable towards each other for accommodating different sizes of cartons. The collapsed cartons indicated by the reference numeral C are arranged in a stack within the magazine. The mechanism for extracting cartons from the magazine and transferring them to the conveyor 14 comprises a first suction means generally indicated at 26 and a second suction means generally indicated by the reference numeral 28.

Suction means 26 includes a block 30 fixed to a pivoted shaft 32 and a pair of hollow arms 34 adjustably mounted in block 30. A pair of suction cups 36 are mounted near the end of each arm 34 and are pneumatically connected to the hollow interior of the arm. Tubes 38 connect the opposite ends of arms 34 to a source of air at sub-atmospheric pressure indicated at 40 to create suction in cups 36. Arms 34 are reciprocated by drive mechanism within the enclosed framework 12 between a carton extruding position as shown in dotted lines in FIG. 1 to and slightly beyond a first point or position shown in full lines in FIG. 1. As arms 34 move away from the dotted line position, the lowermost carton is extracted from the stack within magazine 20. Escapement mechanism, not shown but well known in the art, allows the cartons to be extracted one at a time.

Suction means 28 includes a block 42 fixed to a shaft 44 and three suction units 46 mounted at equadistant points on the block 42. Each unit 46 includes a bracket 48 which supports a pair of tubes 50. There is a suction cup 52 mounted on the ends of each tube 50. Shaft 44 is rotated by drive mechanism within enclosed framework 12 in synchronism with the first suction means 26 so that shaft 44 makes one revolution for each three reciprocations of arms 34. The timing is such that the suction cups 52 of one of the units 46 will engage a carton being transported by suction cups 36 when arms 34 reach the first position indicated by full lines in FIG. 1. The suction to cups 34 is cut off by a valve 54 located intermediate lines 38 and source 40. A cam 56 driven in timed relation with the second suction means 28 closes valve 54 to deactivate first suction means 26 when it is in the full line position as shown in FIG. 1. The carton is thereby released from first suction means 26 just after it is engaged and held by the suction cups 52 of second suction means 28. Arms 34 have a small amount of overtravel after suction is cut off to the cups 36 to allow the carton to be swung down by one of the units 46 of second suction means 28 from the first point or position representd by partially expanded carton C1 to a second point or position within one of the conveyor buckets 18 just ahead of the position shown by fully expanded carton C2.

Figure 3:
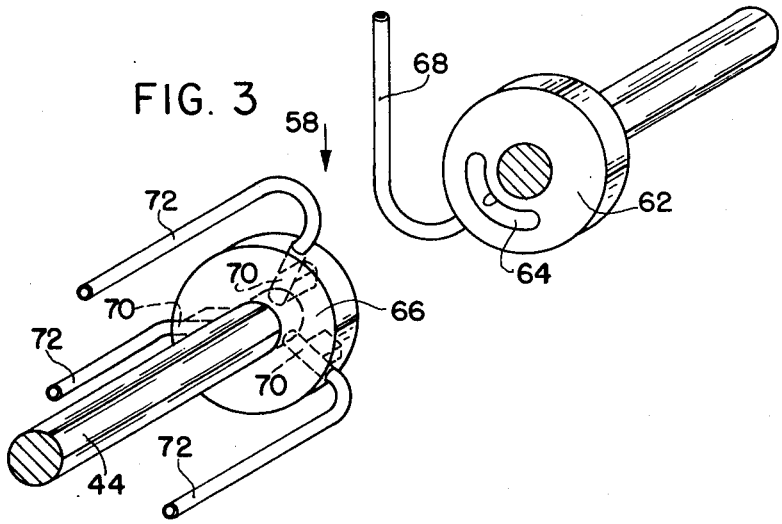
FIG. 3 is a fragmentary exploded view of a valve for controlling the vacuum to the packaging machine.

Valve means generally indicated by the reference numeral 58 in FIG. 3 operates in timed relation with first suction means 28 to activate each unit 46 when it reaches the position of engagement with a carton at the first point indicated by carton C1 and to deactivate the unit after it has placed the carton within a bucket 18.

Block 42 has a port 59 for each unit 46. The tubes 50 of each unit 46 are connected to their respective ports by channels 60 within the block, see FIG. 2. Valve 58 comprises a first stationary disc 62 which contains a radial slot 64 and a second disc 66 which is fixed to shaft 44 for rotation therewith. Slot 64 is pneumatically connected to subatmospheric pressure source 40 by an air line 68 so that a vacuum condition is always present in slot 64. Disc 66 has three slots 70 which extend along the face of disc 66 which abuts disc 62. Slots 70 are disposed at equadistant points along the face of disc 66 and pneumatically communicate with slot 64 during periods of alignment therewith as disc 66 rotates relative to disc 62. Air lines 72 connect slots 70 to corresponding ports 59 in block 42 so that as each unit 46 moves from the first position to the second position above the conveyor, its corresponding slot 70 will be aligned with slot 64 and the unit will be activated. The unit will be deactivated during the remainder of its travel as its corresponding slot 70 will not be aligned with slot 64. Each unit 46 will be activated in turn as it travels between the first and second positions. Additional blocks 42 with units 46 could be employed for large packges if desired. The air lines 72 could be split to accommodate additional units. By the same token some of the suction cups 52 or 36 could be removed and the openings sealed to accommodate smaller packages.

The means for expanding the cartons and spreading the flaps thereof as the cartons are transferred, comprise several stationary cams. The collapsed cartons in the magazine have flaps which must be spread at at least one end thereof to enable product to be easily inserted within the expanded carton; see FIGS. 4 – 7. These flaps comprise first side flap 74, a second side flap 76 and a front flap 78 with a tuck portion 80 which lie in the same planes as the sides of the cartons from which they extend. The first side flap and front flap lie in the same plane when the carton is in the collapsed state in the magazine.

Figure 4:
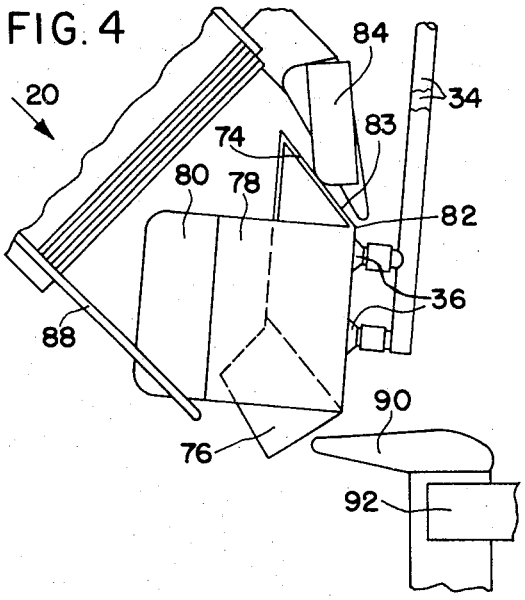
FIGS. 4, 5, 6 and 7 are fragmentary views illustrating the sequence of steps for expanding a carton and spreading the flaps thereof as the carton is transferred from a magazine stack to a bucket conveyor.
Figure 5:
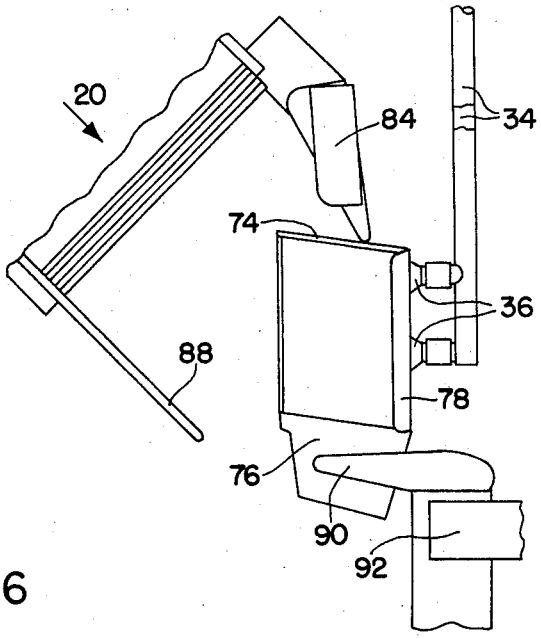
Figure 5:
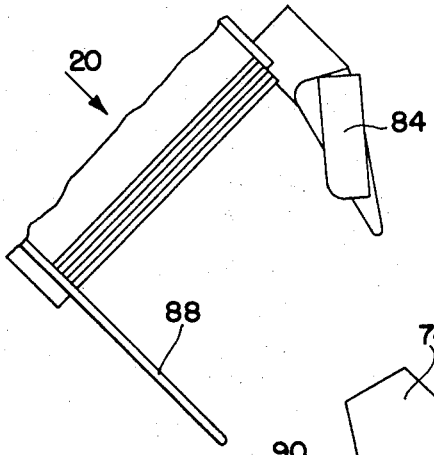
Figure 6:
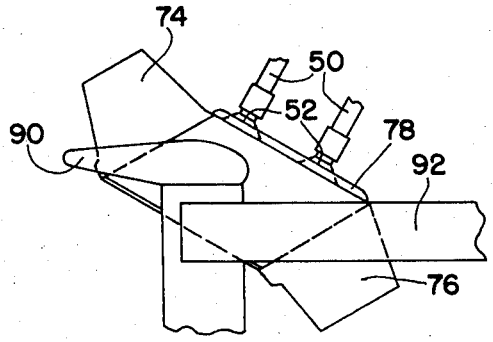

The steps of expanding a carton and spreading the flaps are shown diagramatically in FIGS. 4, 5, 6 and 7. After arms 34 have extracted a collapsed carton from the stack in the magazine, the upper leading edge 82 and the surface 83 of the carton strike the lower surface of a first stationary cam 84 which causes the carton to expand as shown in FIG. 4. While the carton is partially expanded, the front flap 78 strikes the inside surface of a second stationary cam 88. This forces front flap 78 inwardly toward the carton and since the carton is only partially expanded, second side flap 76 is engaged by the front flap and spread outwardly as shown in FIG. 4. As the carton continues to be moved downwardly, flap 76 which now extends below the carton strikes the inside surface of a third cam 90. Flap 76 is held in the spread position by cam 90 as the carton continues to move down so that front flap 78 springs free of cam 88 as shown in FIG. 5. At this point, the carton is transferred from first suction means 26 to second suction means 28. The carton is thereby carried downwardly and partially rotated around its longitudinal axis as it swings along an arc from the center of shaft 44. This motion brings the first side flap 74 into contact with cam 90 and is spread outwardly as the carton continues to be carried down as shown in FIG. 6.

Figure 7:
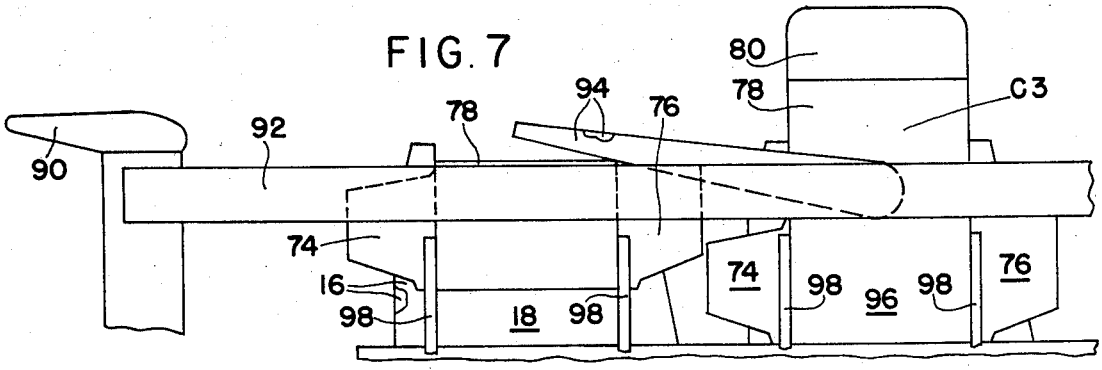

Front flap 78 rides over cam 90 and continues to ride over an extension 92 of cam 90 after the carton is brought to the second position into a bucket 18. The suction to the unit 46 carrying the carton is cut off at the second point and the carton is then transported horizontally by the trailing lug 16 which forms part of the bucket 18 into which the carton is deposited. Extension 92 continues to maintain side flaps 74 and 76 in the spread position. The carton is nearly expanded as the lugs assume a vertical position as shown in FIG. 7. Full expansion to the point where the carton is completely squared or expanded occurs when the carton engages the lower surface of a pair of fourth cams 94 and is pushed down to the conveyor so that the opening 96 of the opened carton is below extension 92 to receive a product as shown in FIG. 7. Walls 98 of a product conveyor which travels in synchronism with conveyor 14 are aligned with the carton as it travels horizontally within a bucket 18. The inside surface of extension 92 maintains the side flaps 74 and 76 in the spread position as the carton is fully expanded. When the carton reaches its final lower position as indicated by carton C3 in FIG. 7 the inside edge of walls 98 maintain side flaps 74 and 76 in the spread position. Front flap 78 is spread outwardly by the inside surface of extension 92 as the carton is forced down by cams 94 as illustrated by carton C3 in FIG. 7. At this point all of the flaps are spread, the carton is fully expanded and is ready for the insertion of a product.

I claim:

1. A method of expanding a collapsed carton and spreading the flaps of at least one end of said carton, the flaps of said carton, when it is in the collapsed state, lie in the same plane as the sides of the carton from which they extend and while said carton is in the collapsed state, said flaps comprise a first side flap, a second side flap and a front flap including a tuck flap, said front flap extending beyond said side flaps and lying in the same plane as said first side flap, said method comprises:

a. partially expanding said carton;

b. closing said front flap while said carton is partially expanded and thereby spreading said second flap outwardly;

c. holding said second flap open while spreading said first and front flaps outwardly by applying pressure from the inside surfaces thereof; and d. fully expanding said carton while holding said first, second and front flaps in their spread position.

2. A method of expanding a collapsed carton and spreading the flaps of at least one end of said carton, the flaps of said carton, when it is in the collapsed state, lie in the same plane as the sides of the carton from which they extend and while said carton is in the collapsed state, said flaps comprise a first side flap, a second side flap and a front flap including a tuck flap, said front flap extending beyond said side flaps and lying in the same plane as said first side flap, said method comprises:

a. stacking collapsed cartons in a magazine with the front and first flaps down;

b. extracting a carton from said stack by means of a suction device and transporting said carton downwardly;

c. partially expanding carton during said downward motion;

d. closing said front flap while said carton is partially expanded during said downward motion and thereby spreading said second flap outwardly;

e. partially rotating said carton around its longitudinal axis during said downward motion so that said second flap extends below the remainder of said carton;

f. engaging the inside surface of said second flap with a rigid member; and g. rotating said carton around its longitudinal axis during said downward motion while releasing said front flap so that said first and front flaps will be spread outwardly from the inside by said rigid member; and h. fully expanding said carton while holding said first, second and front flaps in their open position.

* * * * *